US007874968B2

(12) United States Patent
Foucault

(10) Patent No.: US 7,874,968 B2
(45) Date of Patent: Jan. 25, 2011

(54) LEG REHABILITATION APPARATUS

(76) Inventor: Andre Foucault, 129, Campagna, Victoriaville, Quebec (CA) G6P 5J3

( * ) Notice: Subject to any disclaimer, the term of this patent is extended or adjusted under 35 U.S.C. 154(b) by 0 days.

(21) Appl. No.: 12/421,591

(22) Filed: Apr. 9, 2009

(65) Prior Publication Data

US 2009/0258767 A1 Oct. 15, 2009

Related U.S. Application Data

(60) Provisional application No. 61/044,071, filed on Apr. 11, 2008.

(51) Int. Cl.
*A63B 21/008* (2006.01)
*A61H 1/00* (2006.01)

(52) U.S. Cl. ..... 482/112; 601/34

(58) Field of Classification Search ..... 482/101, 482/112–113; 601/5, 33–35; 602/5, 16, 602/26

See application file for complete search history.

(56) References Cited

U.S. PATENT DOCUMENTS 4,782,827 A * 11/1988 Paratte ..... 602/35
4,834,073 A * 5/1989 Bledsoe et al. ..... 601/34
4,974,830 A * 12/1990 Genovese et al. ..... 601/29
5,035,233 A 7/1991 Ruf
5,399,147 A 3/1995 Kaiser
5,901,581 A * 5/1999 Chen et al. ..... 601/34
6,217,532 B1 4/2001 Blanchard
6,224,521 B1 5/2001 Foucault
6,267,735 B1 7/2001 Blanchard
6,325,770 B1 * 12/2001 Beny et al. ..... 601/34
2006/0064044 A1 * 3/2006 Schmehl ..... 601/34

* cited by examiner

*Primary Examiner*—Fenn C Mathew

(57) ABSTRACT

A leg rehabilitation apparatus comprises a base including first and second base members, wherein the first base member is linearly adjustably connected to the second base member. The first base member including an adjustable thigh support member attached thereto; the second base member including a movable boom attached thereto via a resistance module that offers adjustable dynamic resistance there between during relative movements thereof. The adjustable boom including a bracket that is linearly movable along the length of the boom; the bracket including an adjustable foot and ankle rest, such that a user can place their thigh upon the thigh support member and a foot within the foot and ankle rest and thereby move their leg in a plurality of motions against the resistance of the resistance module in order to exercise and rehabilitate chosen muscle groups within the leg.

15 Claims, 7 Drawing Sheets

LEG REHABILITATION APPARATUS

This application claims priority based on provisional application 61/044,071 filed Apr. 6, 2008.

FIELD OF THE INVENTION

The present invention relates generally to rehabilitation equipment but more particularly to an orthopedic exerciser for therapy, post-surgery rehabilitation or healing of lower limbs

BACKGROUND OF THE INVENTION

Several exercises have been proposed in different rehabilitation programs to help rehabilitate various muscle groups of the leg but the apparatuses used do not offer resistance for certain movements. This inventor has been involved in the field for over 10 years and has a number of Canadian patents such as 2239144, 2273777, 2429219 and 2526174.

SUMMARY OF THE INVENTION

It is a main advantage of this invention to provide for a for a device allowing for a new range of motion simulating the main functional activities for people experiencing limitations in weight bearing.

In order to do so, the invention comprises a base including first and second base members, wherein the first base member is linearly adjustably connected to the second base member; the first base member including an adjustable thigh support member attached thereto; the second base member including a movable boom attached thereto via a resistance module that offers adjustable dynamic resistance there between during relative movements thereof; the adjustable boom including a bracket that is linearly movable along the length of the boom; the bracket including an adjustable foot and ankle rest, such that a user can place their thigh upon the thigh support member and a foot within the foot and ankle rest and thereby move their leg in a plurality of motions against the resistance of the resistance module in order to exercise and rehabilitate chosen muscle groups within the leg.

Preferably, the linearly adjustable connection between the first and second base members is formed as a telescoping connection, and the first and second base members are U-shaped.

In a preferred embodiment, the thigh support member is pivotally connected to the first base member and includes a telescoping support member.

The resistance module includes interconnected gears and a tensioning piston, such that when a force is exerted on the tensioning piston the boom can be raised or lowered angularly with respect to the second base member. The interconnected gears includes a linear gear and a circular gear.

The resistance module further includes a rotating plate which allows the boom to move from side to side with respect to the second base member.

The resistance module further includes a spade member which allows the boom to move from side to side with respect to the second base member; and a secondary piston member that presses against the spade member and assists in moving the boom from side to side with respect to the second base member while also providing resistance for a user when bringing the boom towards a central position.

One of the gears further includes biased pins that are capable of being adjustably inserted into notches within the rotating plate to thereby provide a means for adjusting the range of lateral movement of the boom.

The foot and ankle rest is pivotally connected to the bracket.

The plurality of motions includes vertical rotation, lateral rotation, and linear motions.

The rehabilitation apparatus further including stabilizers slidingly connected to the second base member and adapted to provide extra stability to the apparatus if needed.

The second base member further includes removable blocking tabs that are adapted to limit the range of motion of the boom.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION

Figure 1A:
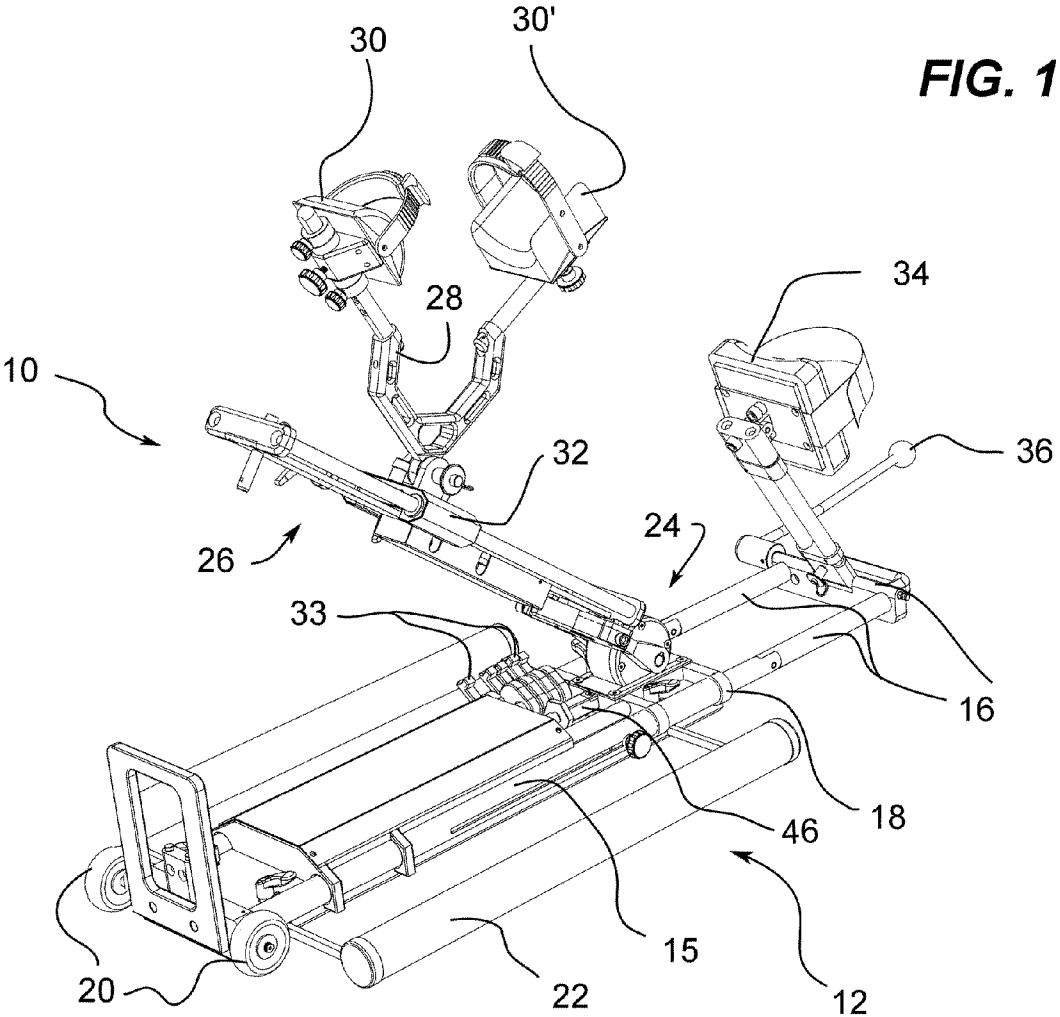
FIGS. 1*ab* Isometric view of the invention with the boom horizontally and at an angle, respectively.
Figure 1B:
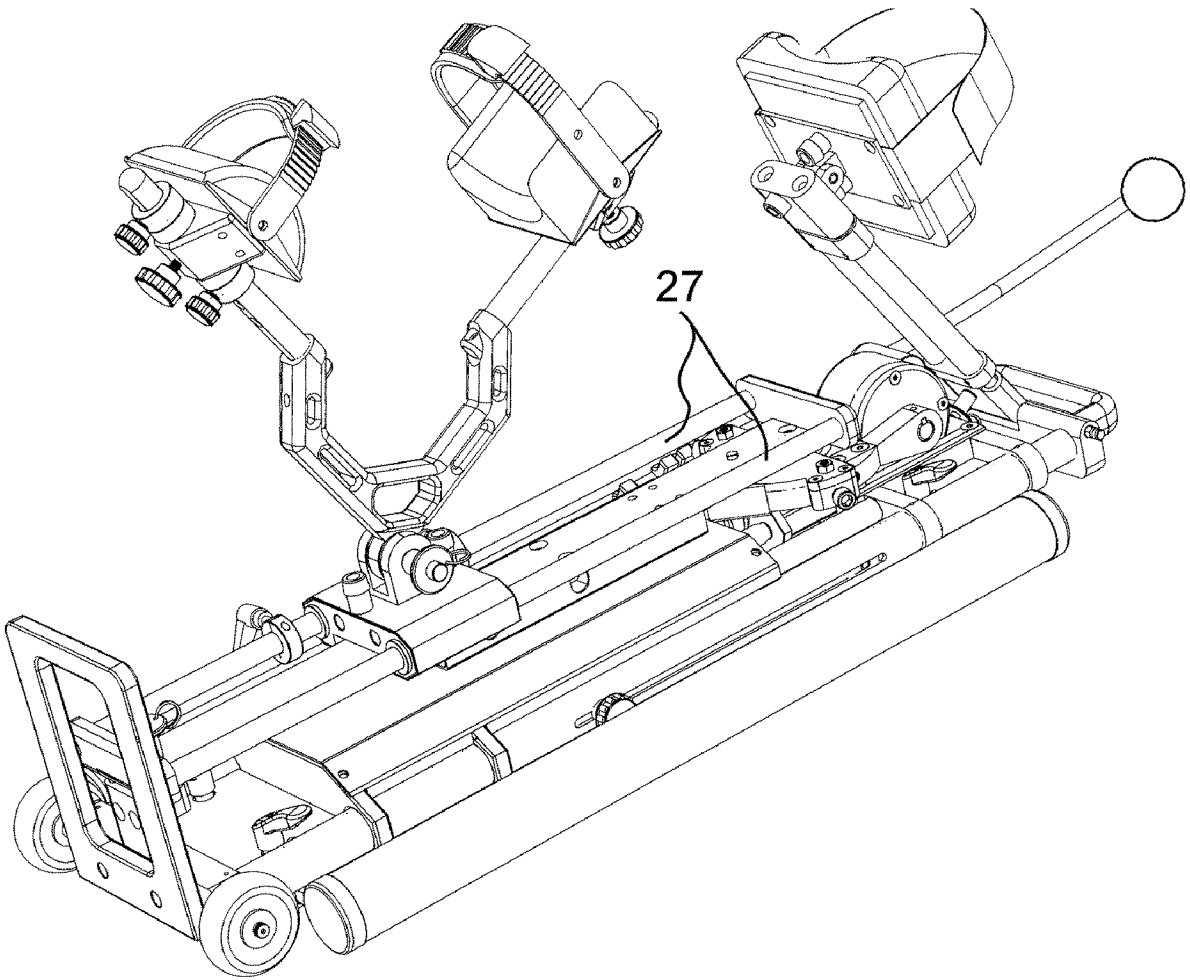
Figure 2B:
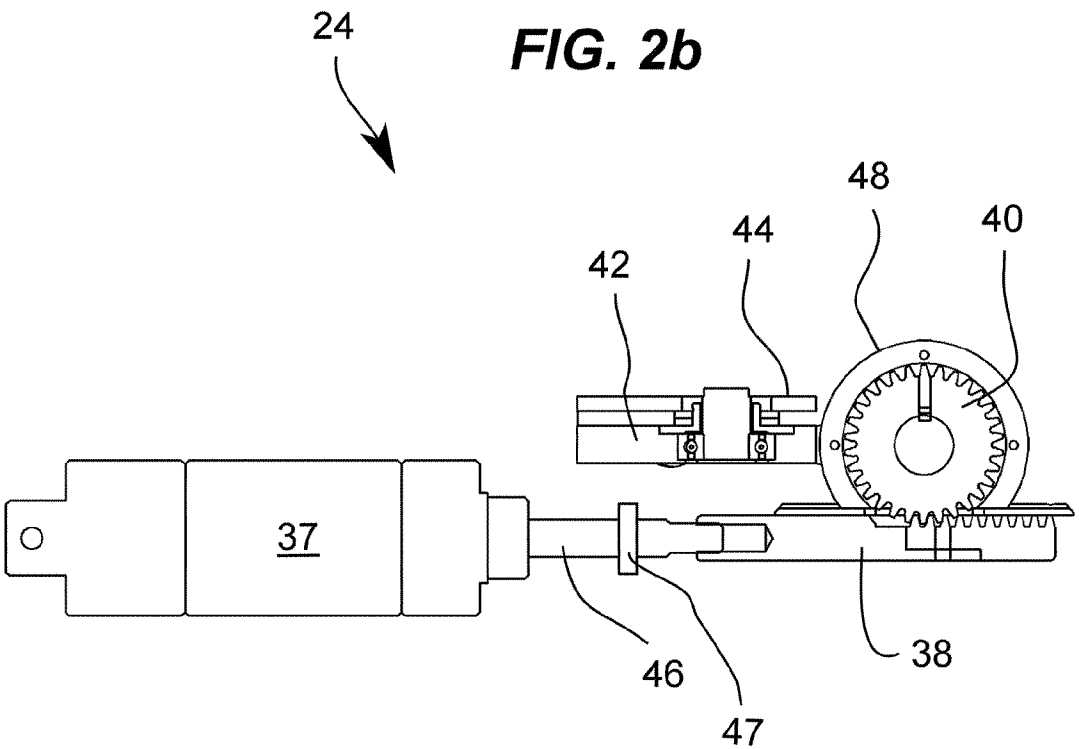
FIGS. 2*a-b* Rear and side cutaway views, respectively, of the main assistance-resistance module.
Figure 2A:
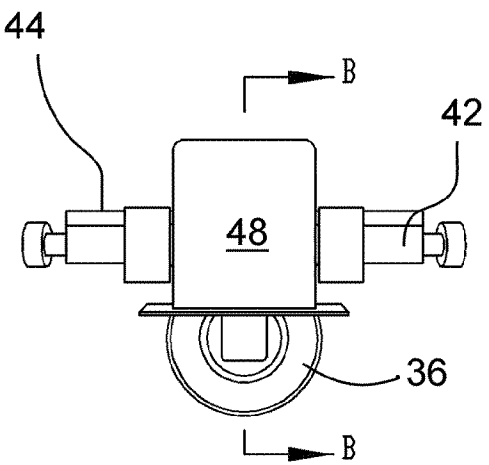
Figure 3A:
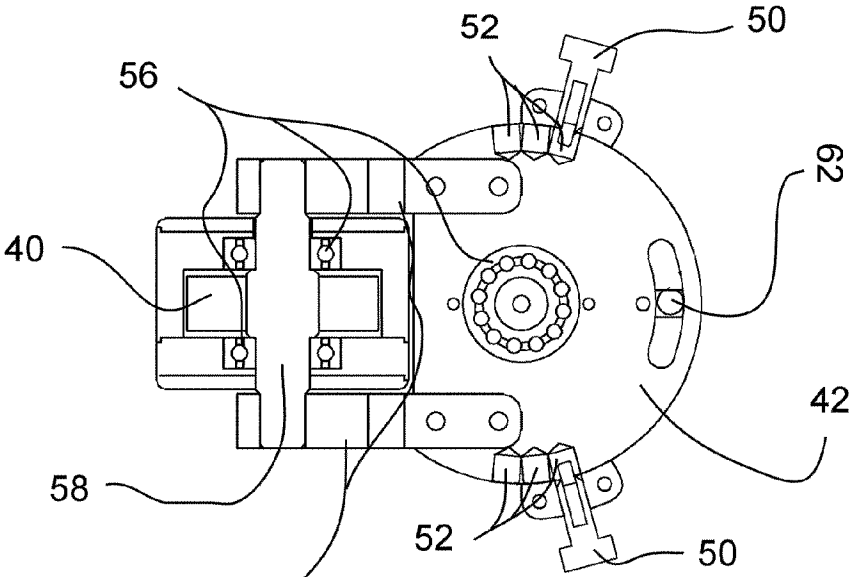
FIGS. 3*a-b* Bottom and reverse side views, respectively, of the assistance-resistance module.
Figure 3B:
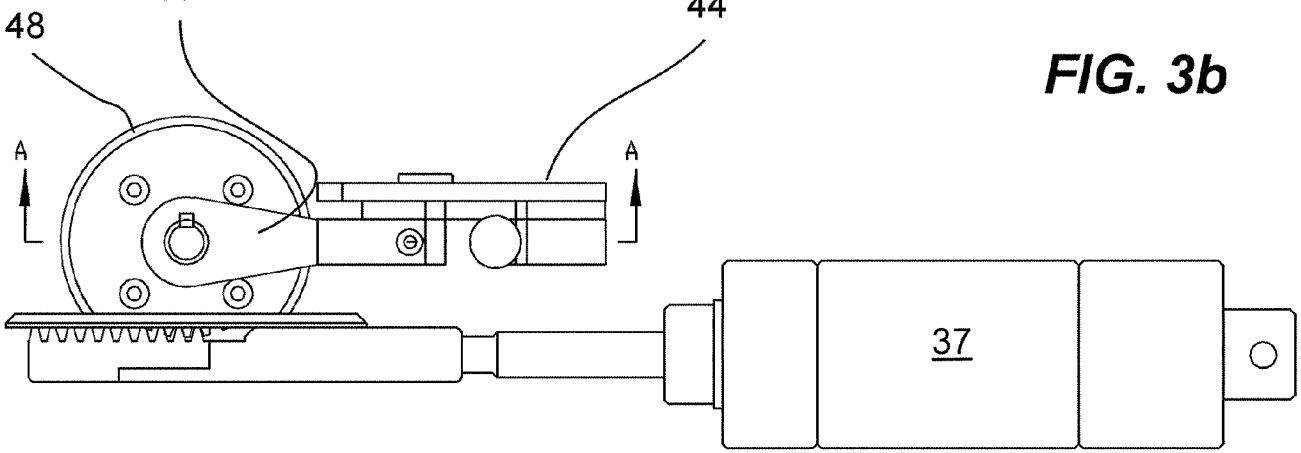

A rehabilitation apparatus (10) has a base (12) and an assistance resistance module (24). The base (12) has a static part (15) consisting of a pair of telescoping parallel tracks (16) adjusting lengthwise so as to vary the distance between a thigh support (34) and the assistance resistance module (24) supported atop a module base (18). The static part (15) can be optionally equipped with wheels (20) for easier transportation. Also, stabilizers (22) can be pulled outwardly and away from the sides of the base (12) so as to provide better stability to the base (12). The stabilizers (22) are locked in position by way of locking handles (23).

The core components are the assistance-resistance module (24), the boom (26), and the foot and ankle rest (28).

The foot and ankle rest (28) has adjustable receptacles (30, 30') which provide comfortable rest and support for the foot and ankle. The foot and ankle rest (28) is rotationally attached to a rest bracket (32) which is itself slidingly attached to the boom (26). These adjustments are important to configure the apparatus (10) to all user sizes as well as specific custom adjustments necessary for a given therapy.

Figure 5C:
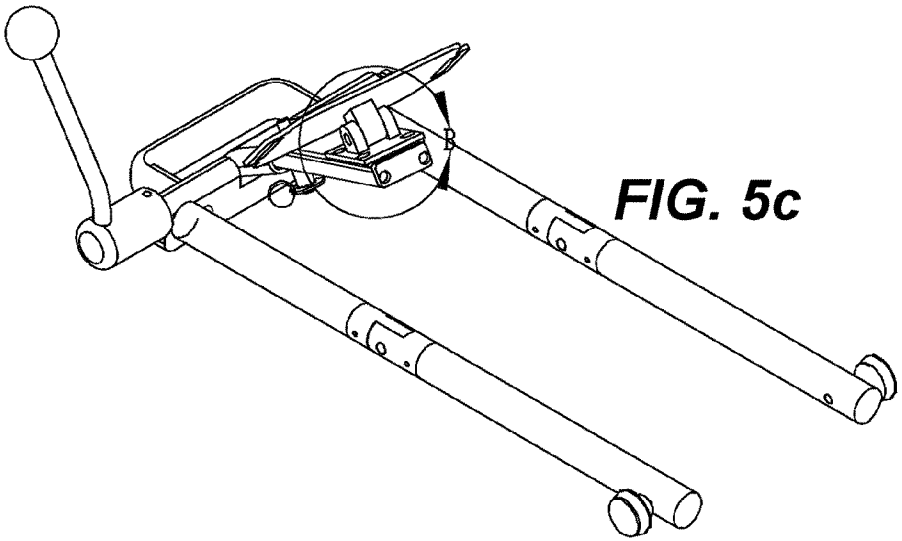
FIGS. 5*a-d* Isometric views of the thigh support and details.
Figure 5B:
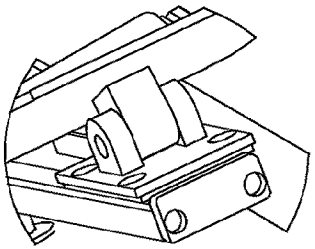
Figure 5D:
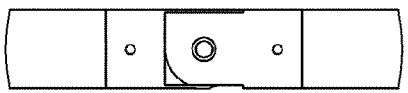
Figure 5A:
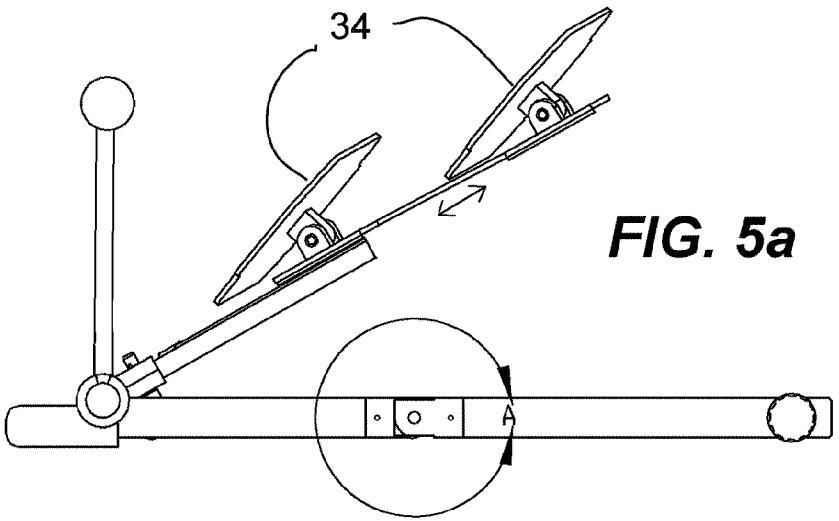
Figure 6:
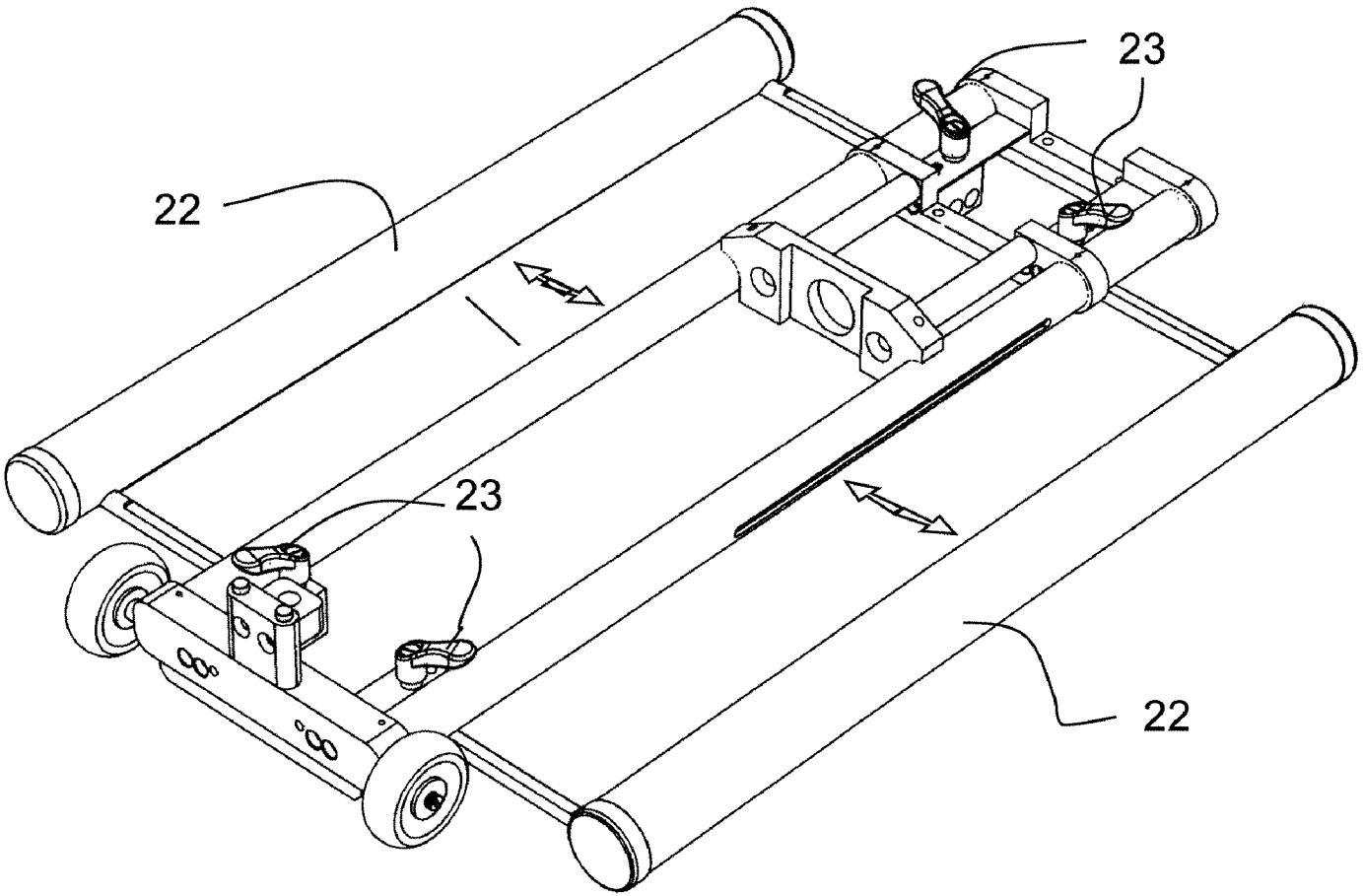
FIG. 6 Isometric view of the base featuring the lateral stabilizers.

The boom (26) by way of the assistance-resistance module (24) can be raised into a vertical rotation plane as well as in a lateral rotation plane. The boom (26) consists of parallel tubes (27). To further stabilize and control the hip joint, an upper thigh support (34), provides support to the thigh. A small lever (36) allows the user to lift the thigh support (34) to further aid in starting the exercise. Furthermore, the thigh support (34) is adjustable, as shown in FIG. 5*a*.

Because of its relative complexity, the resistance module (24) requires further description. A piston (37) provides tension to a linear gear (38) which itself cooperates with a circular gear (40). The circular gear (40) is connected to a connector (42). The connector (42) also connects to the boom (26) by way of a rotating plate (44) that is rotationally attached to the connector (42).

The biasing force exerted by the piston (37) biases the connector (42) upwardly, which is what angularly raises the boom (26), as stated earlier.

Figure 4C:
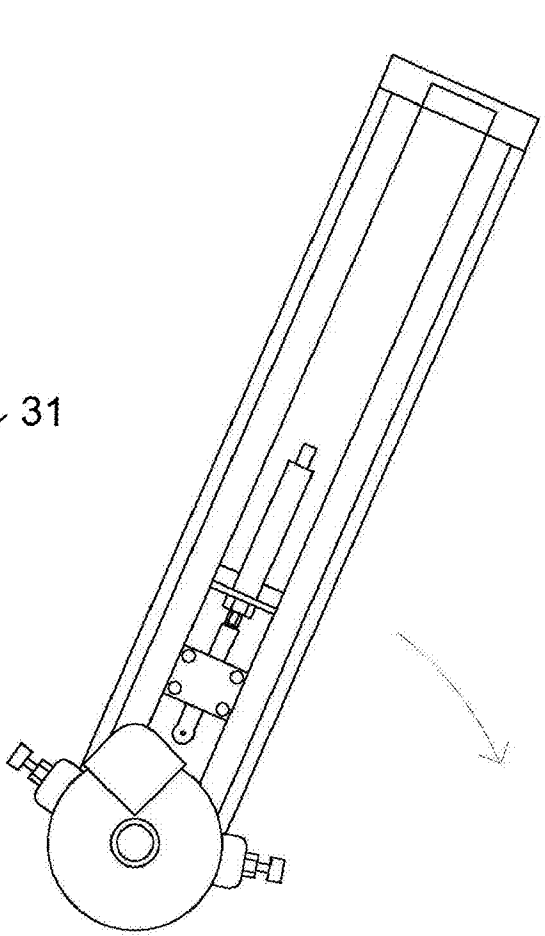
FIGS. 4*a-c* Bottom views of the boom, and secondary side rotation pneumatic force.
Figure 4B:
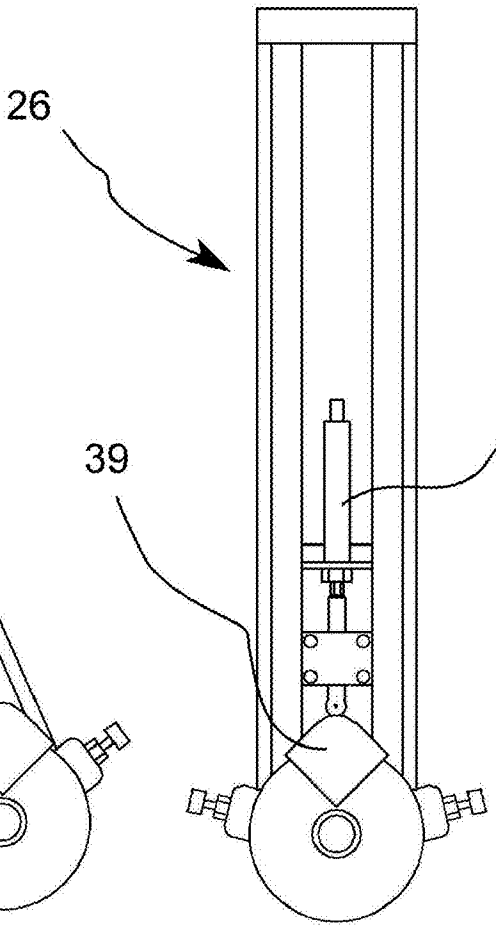
Figure 4A:
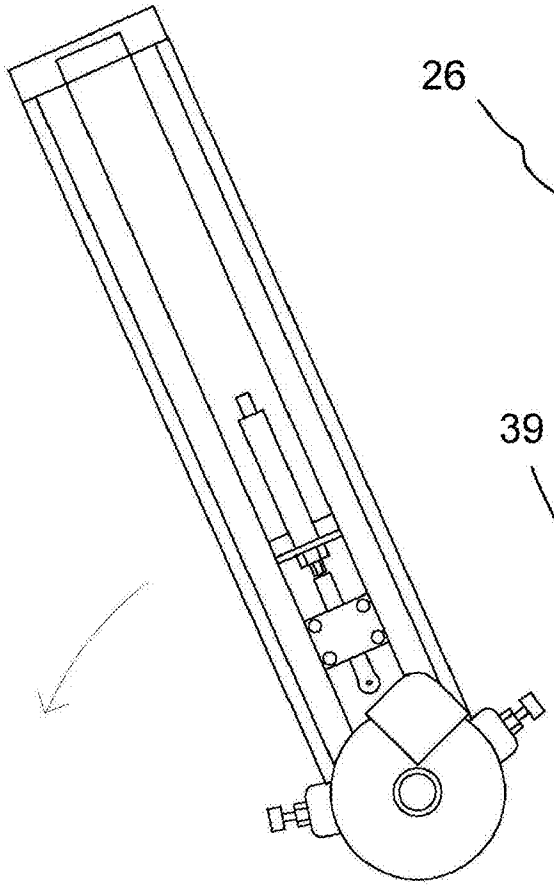

The rotating plate (44) is what allows the boom (26) to move from side to side, as stated earlier. In order to provide assistance to the side to side movement, a secondary piston (31) interacts with a spade (39) by having a secondary piston shaft (41) pressing against the spade (39) as seen in FIG. 4*b*. In doing so, the secondary piston (31) assists in moving the boom (26) from side to side (FIGS. 4*a* and 4*c*) while providing resistance for the user when bringing the boom (26) towards the central position (FIG. 4*b*).

Other components include a piston shaft (46) which links the piston (37) to the linear gear (38), the linear gear (38) forming an extension thereof. A plurality of tabs (33), located on the base (12) selectively limit the vertical rotation of the boom (26) by limiting the course of the piston shaft (46) along the linear gear (38). This is done by flipping or otherwise moving the tabs (33) out of the way of a shaft ring (47) which would otherwise be blocked by any one of the tabs (33). The tabs can be located at both sides of the shaft ring (47) so as to limit the course of the piston shaft (46) in both directions.

The gear (40) is located inside a gear housing (48). A bearing pin (62) cooperate with the pins (50) to limit the lateral movement of the boom (26).

The range of the lateral movement is adjusted by way of pins (50) inserted into notches (52) selected according to the range of motion desired. Ball bearings (56) insure smooth rotational movement between the various components.

A shaft (58) links the gear (40) to arms (60), which are mechanically fastened to the connector (42).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A rehabilitation apparatus comprising a base including first and second base members, wherein said first base member is linearly adjustably connected to said second base member; said first base member including an adjustable thigh support member attached thereto; said second base member including a movable boom attached thereto via a resistance module that offers adjustable dynamic resistance there between during relative movements thereof; said adjustable boom including a bracket that is linearly movable along the length of said boom; said bracket including an adjustable foot and ankle rest, such that a user can place their thigh upon said thigh support member and a foot within said foot and ankle rest and thereby move their leg in a plurality of motions against the resistance of said resistance module in order to exercise and rehabilitate chosen muscle groups within said leg;

the linearly adjustable connection between said first and second base members is formed as a telescoping connection;

said first and second base members are U-shaped;

said thigh support member is pivotally connected to said first base member and includes a telescoping support member;

said resistance module includes interconnected gears and a tensioning piston, such that when a force is exerted on said tensioning piston said boom can be raised or lowered angularly with respect to said second base member.

2. The rehabilitation apparatus of claim 1, wherein said interconnected gears includes a linear gear and a circular gear.

3. The rehabilitation apparatus of claim 1, wherein said resistance module further includes a rotating plate which allows said boom to move from side to side with respect to said second base member.

4. The rehabilitation apparatus of claim 3, wherein said resistance module further includes a spade member which allows said boom to move from side to side with respect to said second base member; and a secondary piston member that presses against said spade member and assists in moving said boom from side to side with respect to said second base member while also providing resistance for a user when bringing said boom towards a central position.

5. The rehabilitation apparatus of claim 3, wherein one of said gears further includes biased pins that are capable of being adjustably inserted into notches within said rotating plate to thereby provide a means for adjusting the range of lateral movement of said boom.

6. The rehabilitation apparatus of claim 1, wherein the foot and ankle rest is pivotally connected to said bracket.

7. The rehabilitation apparatus of claim 1, wherein said plurality of motions includes vertical rotation, lateral rotation, and linear motions.

8. The rehabilitation apparatus of claim 1, further including stabilizers pivotally connected to said second base member and adapted to provide extra stability to said apparatus if needed.

9. The rehabilitation apparatus of claim 1, wherein said second base member further includes removable blocking tabs that are adapted to limit the range of motion of said boom.

10. A means for rehabilitating comprising a base including first and second base members, wherein said first base member is linearly adjustably connected to said second base member; said first base member including an adjustable thigh supporting means attached thereto; said second base member including a movable boom attached thereto via a resisting means that offers adjustable dynamic resistance there between during relative movements thereof; said adjustable boom including a bracket that is linearly movable along the length of said boom; said bracket including foot and ankle resting means, such that a user can place their thigh upon said thigh supporting means and a foot within said foot and ankle resting means and thereby move their leg in a plurality of motions against the resistance of said resisting means in order to exercise and rehabilitate chosen muscle groups within said leg; the linearly adjustable connection between said first and second base members is formed as a telescoping connection; said first and second base members are U-shaped;

said thigh support member is pivotally connected to said first base member and includes a telescoping support member; said resisting means includes interconnected gears and a tensioning piston, such that when a force is exerted on said tensioning piston said boom can be raised or lowered angularly with respect to said second base member.

11. The rehabilitation apparatus of claim 10, wherein said interconnected gears includes a linear gear and a circular gear, and wherein said resisting means further includes a rotating plate which allows said boom to move from side to side with respect to said second base member.

12. The rehabilitation apparatus of claim 11, wherein said resisting means further includes a spade member which allows said boom to move from side to side with respect to said second base member, and a secondary piston member that presses against said spade member and assists in moving said boom from side to side with respect to said second base member while also providing resistance for a user when bringing said boom towards a central position.

13. The rehabilitation apparatus of claim 11, wherein one of said gears further includes biased pins that are capable of being adjustably inserted into notches within said rotating plate to thereby provide a means for adjusting the range of lateral movement of said boom.

14. The rehabilitation apparatus of claim 10, wherein said plurality of motions includes vertical rotation, lateral rotation, and linear motions.

15. The rehabilitation apparatus of claim 10, wherein said second base member further includes removable blocking tabs that are adapted to limit the range of motion of said boom.

* * * * *